US005332099A

United States Patent [19]

Thornberg

[11] Patent Number: 5,332,099

[45] Date of Patent: Jul. 26, 1994

[54] FEED BARREL

[75] Inventor: Robert Thornberg, Walhalla, N. Dak.

[73] Assignee: Harvest Fuel, Inc., Walhalla, N. Dak.

[21] Appl. No.: 822,298

[22] Filed: Jan. 17, 1992

[51] Int. Cl.[5] ..... B65D 19/08

[52] U.S. Cl. ..... 206/595; 206/597; 220/674

[58] Field of Search ..... 414/607, 608, 623; 220/4.04, 4.05, 4.06, 4.07, 1.5, 631, 608, 623, 23.6, 674; 206/386, 595, 596, 598, 599, 597, 503; 108/51.1, 52.1

[56] References Cited

U.S. PATENT DOCUMENTS

| | | | |
|---|---|---|---|
| 2,685,398 | 8/1954 | King | 414/608 X |
| 3,031,207 | 4/1962 | Bard . | |
| 3,055,529 | 9/1962 | Cameron et al. | 220/4.07 |
| 3,279,640 | 10/1966 | Dodson | 220/4.04 |
| 3,348,722 | 10/1967 | Trevarrow, Jr. | 220/4.04 |
| 3,521,777 | 7/1970 | Vik . | |
| 3,602,368 | 8/1971 | Gould . | |
| 3,812,995 | 5/1974 | Lewis | 220/1.5 |
| 3,942,670 | 3/1976 | Mingus et al. | 206/595 X |
| 3,949,877 | 4/1976 | Santoni . | |
| 4,286,723 | 9/1981 | Schutz | 220/4.04 X |
| 4,664,260 | 5/1987 | Stokes | 206/386 |
| 4,928,839 | 5/1990 | Kruelskie . | |

FOREIGN PATENT DOCUMENTS

| | | | |
|---|---|---|---|
| 1117219 | 5/1956 | France | 220/4.05 |
| 1495012 | 12/1977 | United Kingdom | 206/595 |

*Primary Examiner*—Frank E. Werner
*Assistant Examiner*—James T. Eller, Jr.
*Attorney, Agent, or Firm*—Fredrikson & Byron

[57] ABSTRACT

A generally cylindrical container includes a floor having a downwardly open channel formed therein with a center line disposed away from the center of the floor. The channel serves to divide the floor into unequally sized first and second sections, and is adapted to receive the fork of a forklift. A plurality of containers may be joined together to form a transportable system, with the channels of adjacent containers disposed generally parallel to one another for receiving the forks of a forklift.

6 Claims, 4 Drawing Sheets

FEED BARREL

1. Field of the Invention

The present invention relates generally to containers for storing materials and has particular application in storing and delivering feed for livestock.

2. Background of the Invention

Cattle and a variety of other commercially raised livestock are often provided with "salt licks" or "protein and energy lick blocks" which are placed about the area in which they are being raised. These blocks commonly include a number of vitamins, minerals or other nutrients which function as a dietary feed supplement. Such lick blocks most commonly are produced as large, heavy blocks which are generally cubic in shape and tend to be unwieldy and difficult to handle.

SUMMARY OF THE INVENTION

The present invention provides an improved container design. These containers have proven to have particular utility for storing, transporting and positioning lick-block material. The container includes a generally cylindrical wall and a generally circular floor. The floor and the wall meet to define a curved bottom edge of the container.

To aid in transporting the feed supplement material, the floor of the container includes a channel having a center line disposed away from the center of the floor. The channel thus defines a chord in the circular floor and effectively serves to divide the floor into two unequally sized arcuate sections. The channel is sized and positioned on the floor such that when two containers are positioned adjacent one another in side-by-side abutment with their larger sections disposed toward one another and the channels positioned generally parallel to one another, the channels are adapted to receive a standard-sized fork for a forklift. Forklifts are commonly used to transport materials and would therefore be fairly readily available to transport the feed barrels from the manufacturer to feed stores and ultimately to farms to position them for easy access by the livestock.

The present invention also contemplates a method of positioning feed for livestock. This method includes the steps of providing a plurality of containers according to the invention, attaching at least two containers together in side-by-side abutment as outlined above, and lifting the attached containers with a forklift for transport to a position near their desired location. The containers may then be placed on the ground and detached from one another. If it is desired that the containers be spaced from one another one or more of the containers may be tipped onto its side and rolled into its desired position before being tipped back to rest with its floor upon the ground. In a preferred embodiment, the cylindrical wall of the container is provided with at least one, and preferably two or more, circumferential ridge which extends generally radially outwardly of the wall to assist in rolling the containers.

DESCRIPTION OF THE PREFERRED EMBODIMENTS

Figure 1:
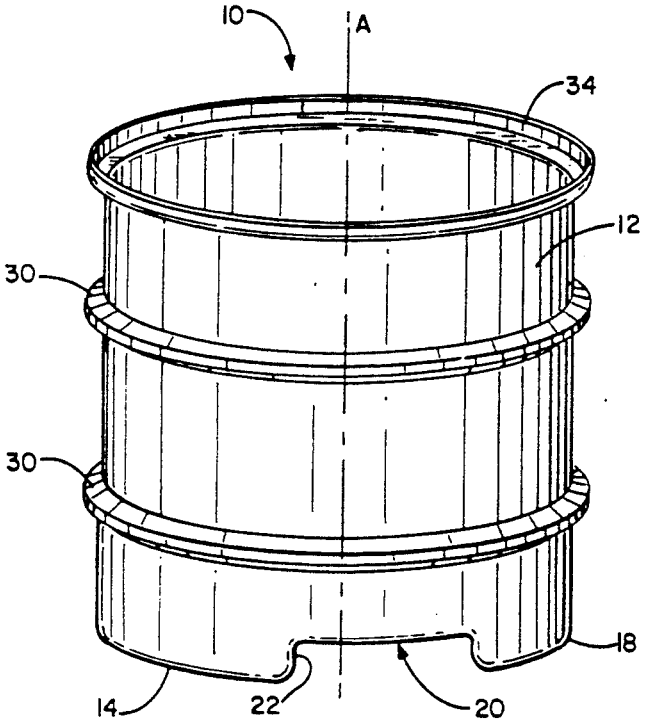
FIG. 1 is a perspective view of the feed barrel.

A container according to the present invention is shown in FIGS. 1–9. A container 10 of the invention includes a generally cylindrical wall 12 and a generally circular floor 14. The floor 14 is desirably integrally formed with the wall to define an interior cavity (16 in FIG. 1). Any material may be stored or placed within this cavity; as noted above, the invention has particular utility in delivering feed or feed supplement material for livestock. The wall and the floor may meet at a relatively sharp angle, but it is preferred that the lower end of the wall meet the floor to define a curved edge 18 of the container. As explained more fully below, this curved edge assists in turning the container on its side for movement.

The floor 14 has a channel 20 formed therein. The channel may be of any desired shape, but preferably is generally C-shaped, as shown in the drawings, and is sized to comfortably receive a fork of a conventionally-sized forklift. As such a fork is generally about four inches wide, the channel should be at least that wide and may extend up to about eight inches wide. The channel extends generally upwardly from the floor and into the interior cavity 16, defining notches 22 in the wall 12 adjacent the lower end thereof. One notch 22 is disposed on each end of the channel 20 where the channel passes through the wall.

Figure 2:
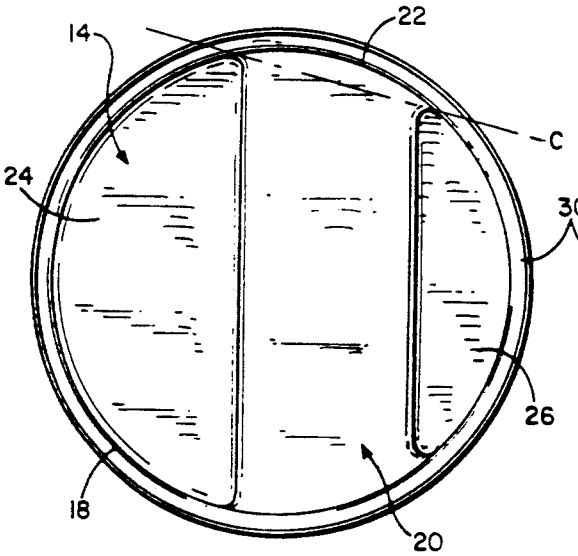
FIG. 2 is a top view of the feed barrel.
Figure 3:
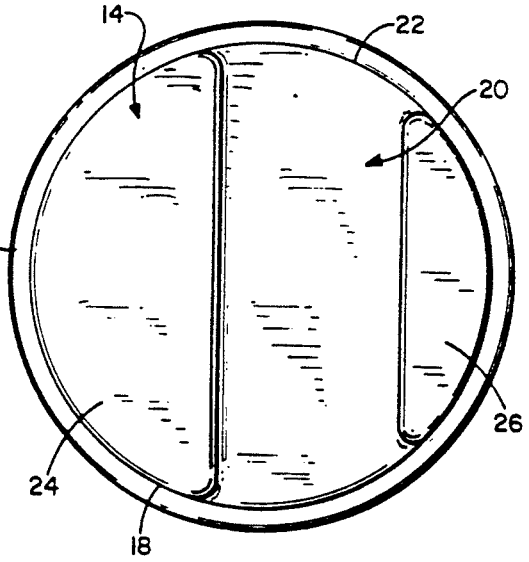
FIG. 3 is a bottom view of the feed barrel.
Figure 4:
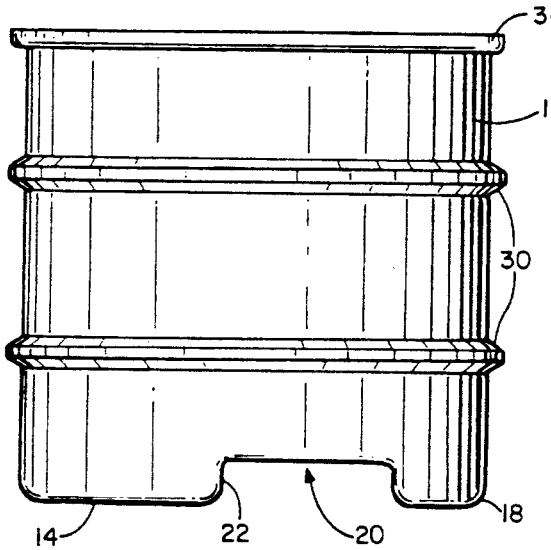
FIGS. 4–7 are side views of the feed barrel, taken along perpendicular axes.
Figure 6:
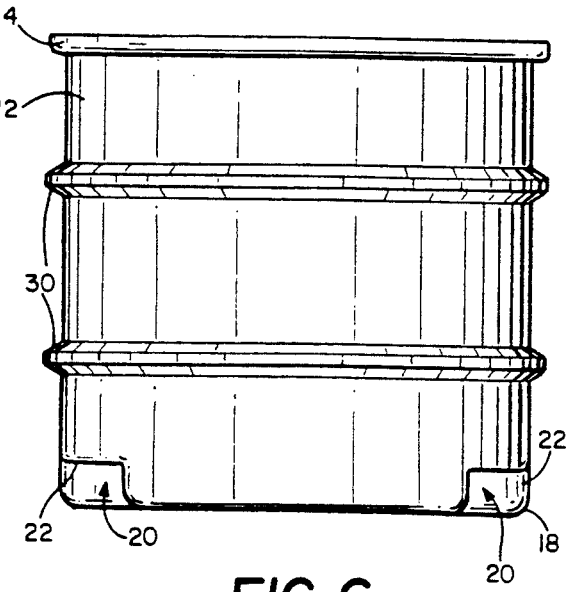
Figure 5:
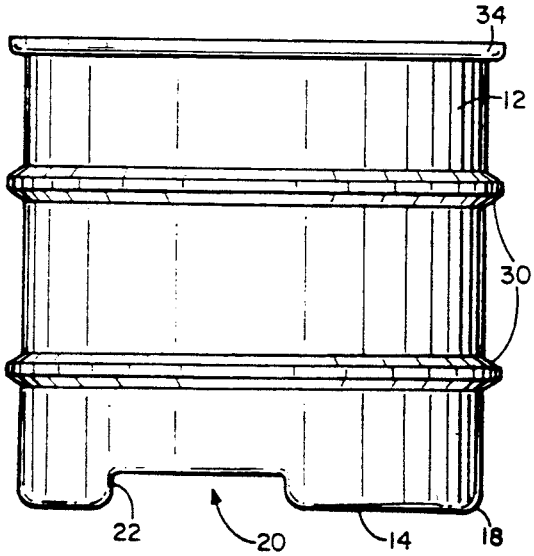
Figure 7:
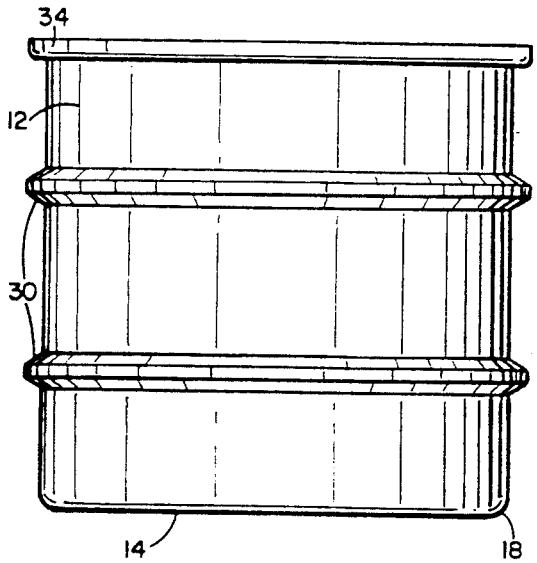

The center line L of the channel 20 is desirably spaced away from the center of the floor 14, i.e., the axis A of the generally cylindrical wall 12. The channel's center line 20 therefore does not define a diameter of the floor, but rather describes a shorter chord which extends through a narrower portion of the floor. As shown in FIGS. 2 and 3, this effectively divides the floor 14 into two unequally sized first and second arcuate sections 24 and 26, respectively.

The distance from the channel 20 to the farthest point on the periphery of the first arcuate section 24 is desirably approximately one-half the distance between the tines on a fork of a conventional forklift. The second arcuate section 26 will obviously comprise the remainder of the floor, excluding the first arcuate section 24 and the width of the channel 20. Because the dimensions of the forklift are fixed, the size of this second section will depend almost entirely on the size and geometry chosen for the container.

It is contemplated that the second section 26 will generally range between about one-third and about three-quarters the size of the first section 24. However, it is to be understood that the size of the smaller section can be varied quite widely. The channel could be positioned immediately adjacent the outer edge of the floor such that the smaller section is eliminated entirely if a smaller floor is used; conversely, if a much larger floor is used, the second section 26 may be larger in size than the first section 24. The constant in this determination is the fact that the distance from the channel to the furthermost part of the first section 24 should be approximately one-half the distance between the forks of a forklift, as noted above.

Figure 9:
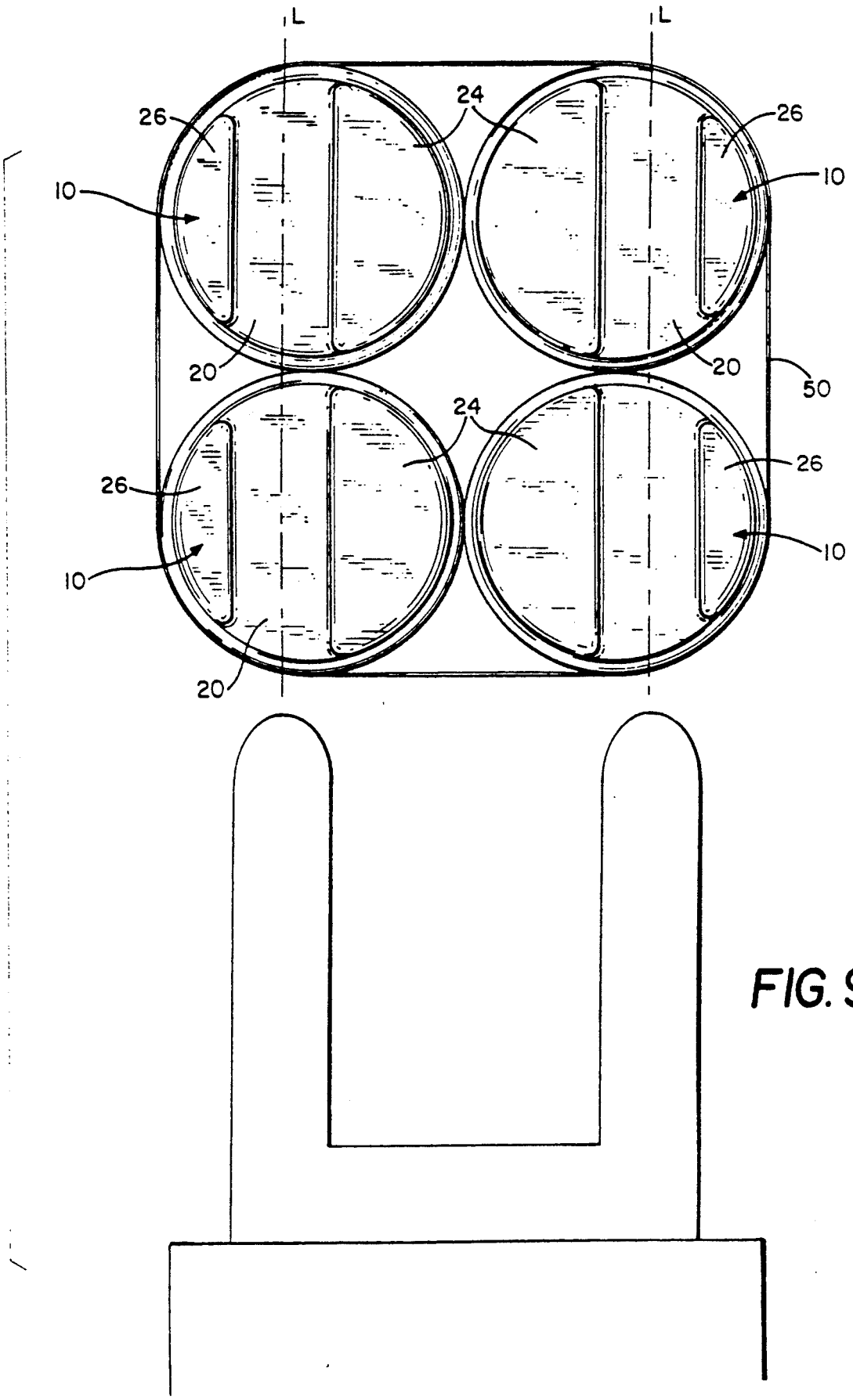
FIG. 9 is a top view showing several feed barrels bound together for transportation with a forklift.

The importance of this distance is borne out in FIG. 9. As can be seen in that figure, it is contemplated that a plurality of containers according to the invention will be provided and that two such containers will be attached to one another in side-by-side abutment. The channels 20 of the containers should be generally parallel to one another and the first sections 24 should be disposed adjacent one another. Because the width of the first section 24 of each container is approximately one-half the distance between the forks 102 of a forklift 100, when the containers are so positioned the channels 20 are positioned to receive the forks 102.

The containers may be attached to one another in any suitable fashion. For instance, a compressive strap 50 may be placed around the containers to hold them together in the desired spacing. Although FIG. 9 shows two pairs of containers, it is to be understood that any number of containers can be attached together. The channels 20 of the additional container or containers should align with the channels in the first pair of containers to permit the fork 102 of the forklift to slide under the containers. It is generally preferred that an even number of containers be attached to one another, forming pairs of containers.

The positioning of the channel provides a critical advantage of the present invention over those known in the prior art. For instance, U.S. Pat. No. 3,942,670 (issued to Mingus et al. on Mar. 9, 1976) teaches the use of a frustoconical attachment for the bottom of a storage barrel. This attachment includes a channel which passes through its diameter for receiving a fork of a forklift.

When a channel having a width passes through a generally cylindrical wall to define a notch therein, this clearly interrupts the curvature of that wall. This effectively defines a short chord C adjacent the periphery of that wall. The dimensions of a channel adapted to receive the fork of a forklift are effectively predetermined in that they must safely receive that fork. Since the width of the channel is effectively fixed, the length of the chord C will vary only with the curvature of the wall adjacent the channel—the greater the curvature, the greater of an interruption in curvature the channel will represent. This produces a chord C which is longer and is closer to the center of the circle than the radius of the circular wall.

Figure 8:
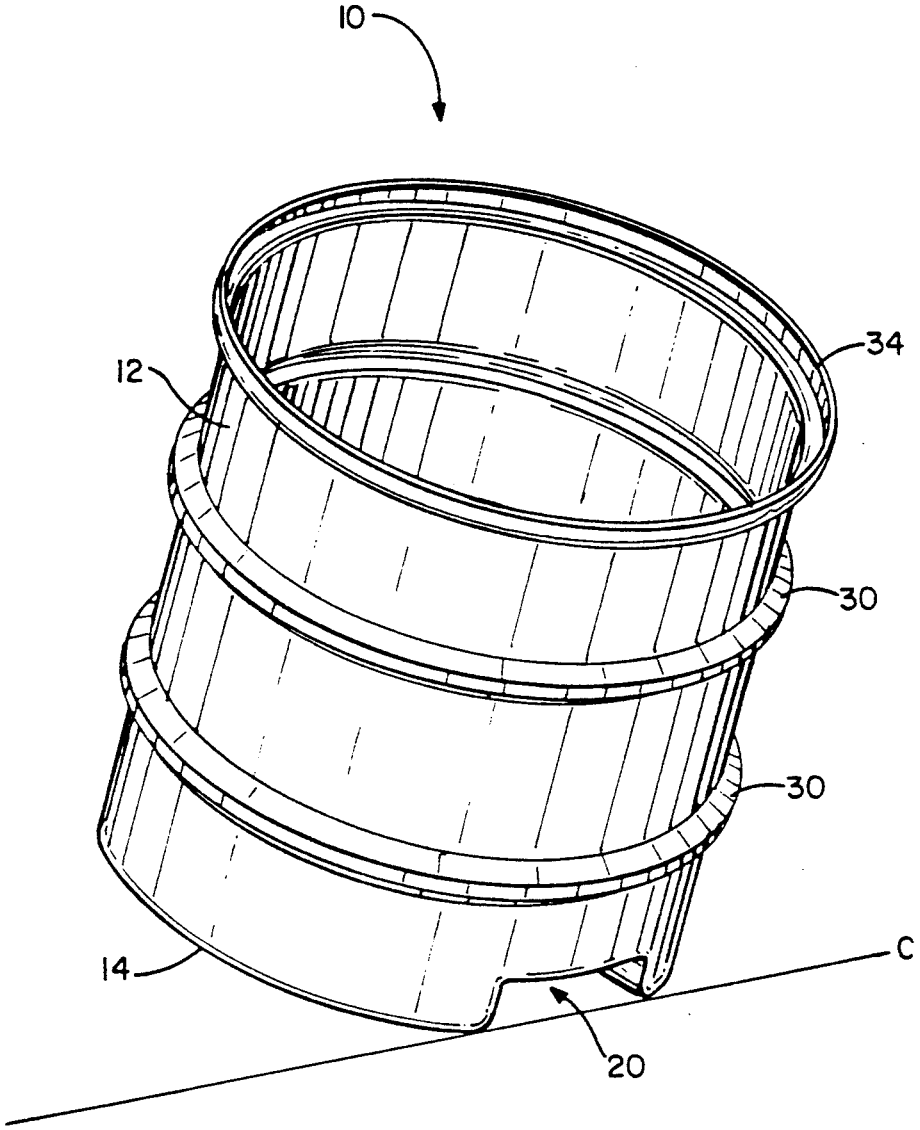
FIG. 8 is a perspective view of the feed barrel.

The frustoconical attachment taught in U.S. Pat. No. 3,942,670 positions the channel along the diameter of the attachment. Obviously, the curvature of the circle is most gradual at its diameter. By displacing the center line L of the channel 20 away from the center of the floor 14 of the present invention, the chord C is longer and is positioned closer to the center of the floor. The significance of this fact is shown in FIG. 8. When attempting to tip the container over on its side such that the wall 12 rests upon the ground, one may do so using the chord C as the fulcrum. Since the fulcrum of the present invention is positioned closer to the axis A of the wall, and therefore the center of gravity of the container and its contents, the moment arm for tipping this container will be reduced. Therefore, it will be easier to overturn the present container 10 along this chord C defined by the channel 20 than if the channel passed through the center of the floor. Additionally, the curvature of the curved edge 18 of the container also helps in tipping the container. Thus, the design of the instant invention provides a stable container which can be approached and used by livestock but is still easier to tip over when so desired by tipping the container adjacent a notch 22 to utilize the chord C as a fulcrum.

It has been found particularly useful to tip over a container 10 of the invention in order to permit the filled container to be moved. When the container is on its side, it may be fairly readily rolled from one location to another rather than having to physically carry it from place to place. Once the container has reached the desired position, it then may be turned upright. As it has been estimated that a container of the invention can weigh up to about 250 pounds or more when filled with feed supplement material, it would be rather difficult to simply manually carry the container. Thus, the ability to roll the container can be very helpful.

If so desired, one or more circumferential ridges 30 may be positioned along the cylindrical wall 12. The circumferential ridges desirably extend generally radially outwardly of the wall to project beyond the rest of the wall. These ridges will therefore contact the ground before the rest of the wall when the container is turned on its side, minimizing friction between the wall 12 and the ground.

It may also be desirable to include an outwardly extending lip 34 at the upper end of the wall 12. The lip may be shaped to receive and engage the curved edge 18 of a second container to permit the containers 10 to be stacked atop one another. This outwardly extending lip would therefore provide greater stability to the containers when they are stacked atop one another.

In an alternative, preferred embodiment, the section 40 of the wall 12 below the bottom-most circumferential ridge ridge 30 has an outer diameter which is less than the inner diameter of the section 42 of the wall above the bottom most circumferential ridge 30. When one container is stacked atop another, the lower portion 40 of the wall of the upper container will reside within the upper portion 42 of the wall 12 of the lower container, thus ensuring a secure fit between the two containers. In this embodiment, the outwardly extending lip is desirably adapted to receive and support the bottom-most circumferential ridge 30, rather than the curved edge 18, of another container when the containers are stacked together.

As mentioned above, the present invention also contemplates a method of transporting and distributing a material, which material may include a salt-lick material. According to the method, a plurality of containers 10 such as those described above are provided and at least two containers are attached to one another in a side-by-side abutting relationship. As set forth in some detail above and shown in FIG. 9, this is desirably done with the first sections 24 of adjacent containers being disposed toward one another to properly position the channels 20 for receiving the forks of a forklift. The attached containers may then be transported to a position adjacent their desired final location by means of a forklift 100, whereupon they may be set down on the ground and detached from one another. One or more of the containers so transported may then be moved to its final, desired position by tipping it over so that it lays on its side and then rolling the container to the desired location before turning it upright again. In both tipping over the container and turning it upright again, it is preferred that the container be tipped adjacent a notch 22 so that it will pivot about the cord C defined by the channel.

While a preferred embodiment of the present invention has been described, it should be understood that various changes, adaptations and modifications may be made therein without departing from the spirit of the invention and the scope of the appended claims.

What is claimed is:

1. A transportable container comprising:

a) a generally cylindrical wall having upper and lower ends; and b) a generally circular floor integrally formed with the wall to define an interior cavity, the lower end of the wall meeting the periphery of the floor to define a curved edge of the container;

c) the floor having a downwardly open channel formed therein, a pair of downwardly open notches in said wall adjacent the lower end of the wall defining opposite ends of the channel, the channel having a center line disposed away from the center of the generally circular floor.

2. The container of claim 1 wherein the wall includes at least one circumferential ridge, the ridge extending generally radially outwardly of the wall.

3. The container of claim 2 further comprising an outwardly extending lip disposed adjacent the upper end of the wall shaped to receive and engage a circumferential ridge of a second container for stacking.

4. The container of claim 1 wherein the channel divides the floor into unequally sized first and second sections, the distance from the channel to the farthest point on the periphery of the first section being approximately equal to one-half the distance between forks of a forklift.

5. A transportable container system comprising a plurality of containers and means for attaching the containers to one another, each of the containers comprising a generally cylindrical wall having upper and lower ends, a generally circular floor integrally formed with the wall to define an interior cavity, the lower end of the wall meeting the periphery of the floor to define a curved edge of the container; the floor having a downwardly open channel formed therein, a pair of downwardly open notches in said wall adjacent the lower end of the wall defining opposite ends of the channel, the channel serving to divide the floor into unequally sized first and second sections, the channels being sized and positioned such that when two containers are positioned in side-by-side abutment with the first sections of their respective floors disposed adjacent one another and the channels disposed generally parallel to one another, said channels may receive the forks of a forklift.

6. A transportable container comprising:

a) a generally cylindrical wall having upper and lower ends; and b) a generally circular floor adjoining the wall to define an interior cavity, the lower end of the wall meeting the periphery of the floor to define a curved edge of the container;

c) the wall having a pair of downwardly open notches positioned adjacent the lower end of the wall, the notches defining opposed ends of a downwardly open channel of the container, the channel having a center line disposed away from the center of the generally circular floor.

* * * * *